US010893779B1

(12) United States Patent
Joyner

(10) Patent No.: US 10,893,779 B1
(45) Date of Patent: Jan. 19, 2021

(54) FOAM ROLL BATH MAT

(71) Applicant: Amy Joyner, Centennial, CO (US)

(72) Inventor: Amy Joyner, Centennial, CO (US)

( * ) Notice: Subject to any disclaimer, the term of this patent is extended or adjusted under 35 U.S.C. 154(b) by 0 days.

(21) Appl. No.: 16/689,344

(22) Filed: Nov. 20, 2019

(51) Int. Cl.
*A47K 3/00* (2006.01)

(52) U.S. Cl.
CPC ..... *A47K 3/002* (2013.01)

(58) Field of Classification Search
CPC ..... A47K 3/002
USPC ..... 4/583, 573.1–575.1, 578.1, 579
See application file for complete search history.

(56) References Cited

U.S. PATENT DOCUMENTS 2,167,178 A * 7/1939 Kohlstadt ..... A47K 3/125 4/575.1
5,829,070 A * 11/1998 Taylor ..... A47K 3/125 4/578.1

* cited by examiner

*Primary Examiner* — Tuan N Nguyen
(74) *Attorney, Agent, or Firm* — Bruce A. Lev

(57) ABSTRACT

A foam roll bath mat comprising suction cups on a bottom surface thereby securing the bath mat to a bathtub to prevent unwanted displacement while in use structured and arranged to allow a user to rest and elevate their legs while bathing.

20 Claims, 2 Drawing Sheets

FOAM ROLL BATH MAT

COPYRIGHT NOTICE

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever. 37 CFR 1.71(d).

BACKGROUND OF THE INVENTION

1. Field of the Invention

The present invention relates generally to the field of bathmat devices and more specifically relates to a foam roll bath mat comprising suction cups on a bottom surface thereby securing the bath mat to a bath tub to prevent unwanted displacement while in use structured and arranged to allow a user to rest and elevate their legs while bathing.

2. Description of the Related Art

Bathing is the washing of the body with a liquid, usually water or an aqueous solution, or the immersion of the body in water such as a bathtub. It may be practiced for personal hygiene, religious ritual or therapeutic purposes.

A bath tub is a large or small container for holding water in which a person or animal may bathe. Most modern bath tubs are made of thermoformed acrylic, porcelain enameled steel, fiberglass-reinforced polyester, or porcelain enameled cast iron. A bath tub is usually placed in a bathroom either as a stand-alone fixture or in conjunction with a shower.

Modern bathtubs have overflow and waste drains and may have taps mounted on them. They are usually built-in, but may be free-standing or sometimes sunken. Until recently, most bathtubs were roughly rectangular in shape but with the advent of acrylic thermoformed baths, more shapes are becoming available. Unfortunately, when a user bathes in a bathtub, they have no place to rest and elevate their legs. Therefore, a need exists for a bath mat that will allow a user to rest and elevate their legs while bathing.

Various attempts have been made to solve the problems which may be found in the related art but have thus far been unsuccessful. A need exists for a reliable foam roll bath mat to avoid the above-mentioned problems.

BRIEF SUMMARY OF THE INVENTION

In view of the foregoing disadvantages inherent in the known art, the present invention provides a novel foam roll bath mat. The general purpose of the present invention, which will be described subsequently in greater detail, is to provide a foam roll bath mat comprising suction cups on a bottom surface thereby securing the bath mat to a bath tub to prevent unwanted displacement while in use structured and arranged to allow a user to rest and elevate their legs while bathing. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and method(s) of use for the present invention, foam roll bath mat, constructed and operative according to the teachings of the present invention.

The various embodiments of the present invention will hereinafter be described in conjunction with the appended drawings.

DETAILED DESCRIPTION

As discussed above, embodiments of the present invention relate to a bath mat device and more particularly to a foam roll bath mat.

Figure 1:
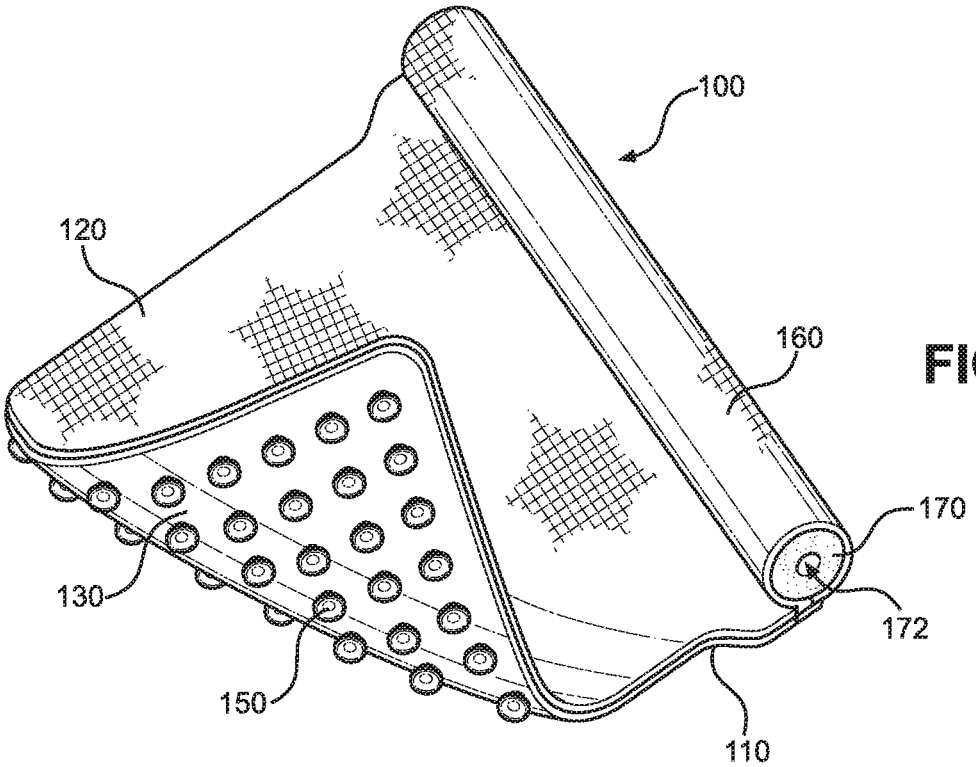
FIG. 1 show a perspective view illustrating the foam roll bath mat according to the preferred embodiment of the present invention.
Figure 2:
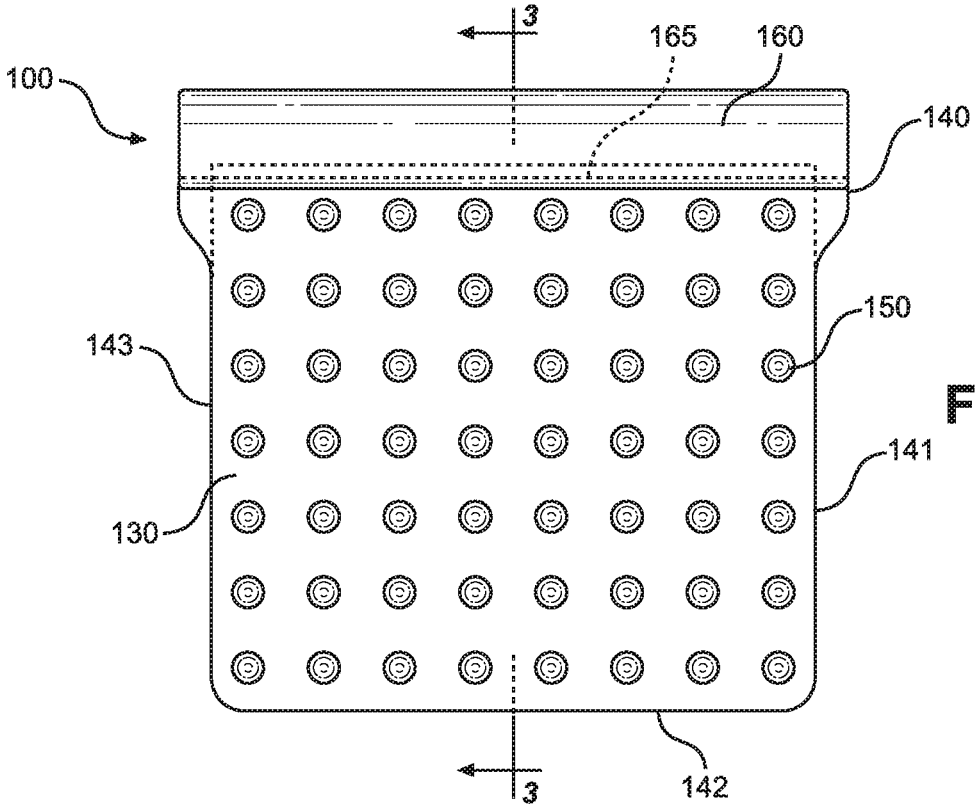
FIG. 2 show a bottom view illustrating the foam roll bath mat according to the preferred embodiment of the present invention in FIG. 1.
Figure 3:
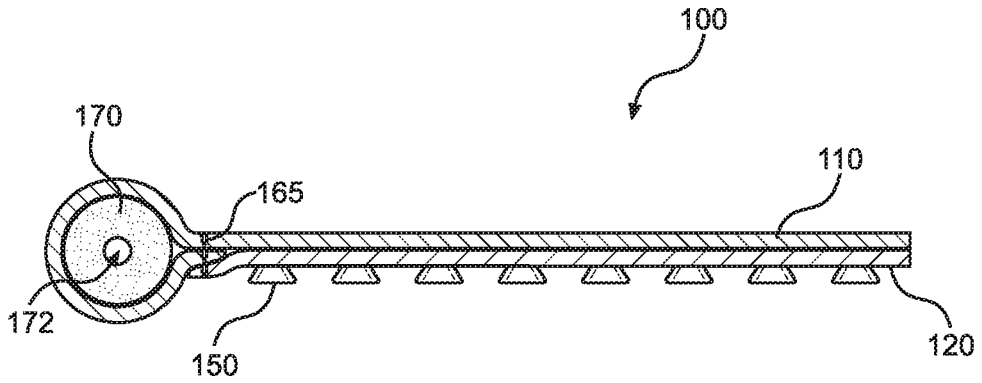
FIG. 3 show a side view illustrating the foam roll bath mat according to the preferred embodiment of the present invention in FIG. 1.
Figure 4:
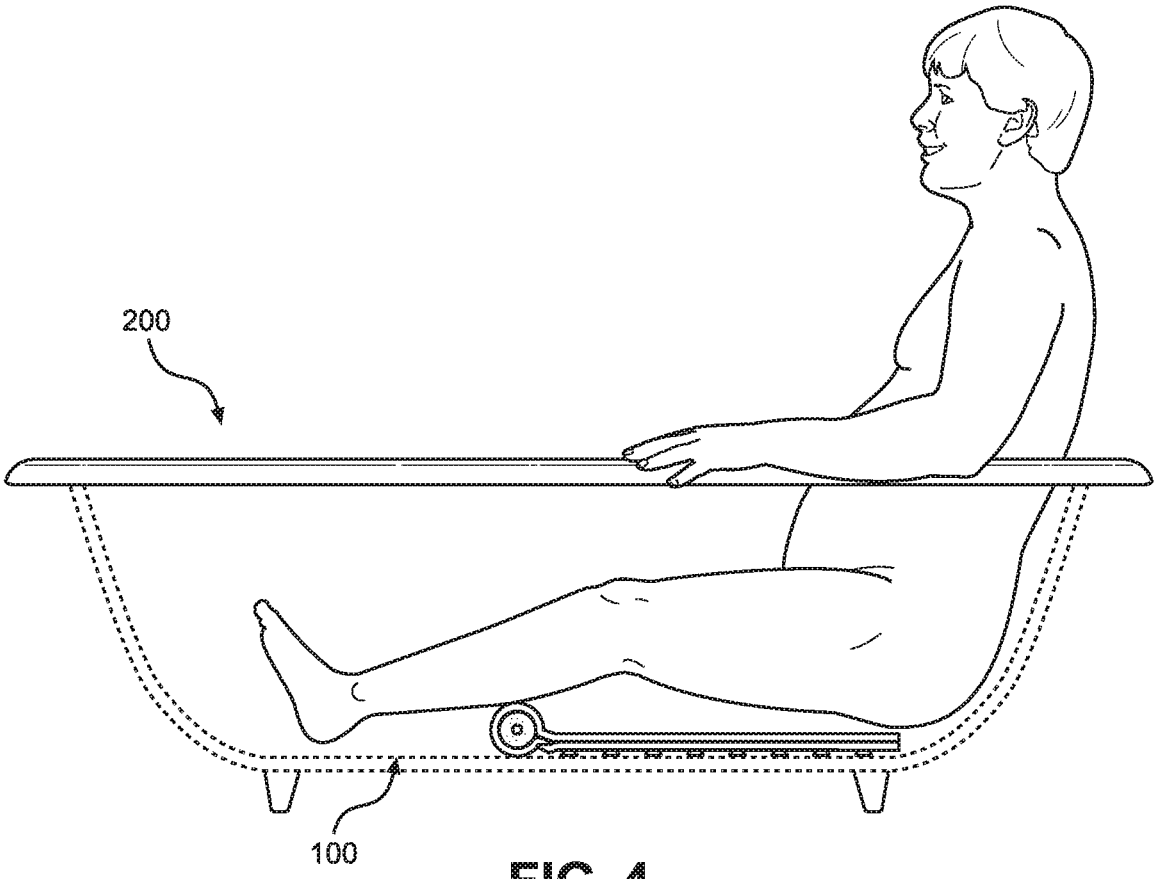
FIG. 4 show a side view illustrating the foam roll bath mat of the preferred embodiment of the present invention in FIG. 1 being used with a bath tub.

Referring now to FIGS. 1-4, a foam roll bath mat is disclosed herein comprising a bath mat having a plurality suction cups on a bottom surface thereby securing the bath mat to a bath tub to prevent unwanted displacement while in use. The bath mat is formed of a waterproof material such as rubber while the suction cups would be manufactured of a similar material. The bath mat can be rectangular in shape and can be made in different lengths to accommodate a wide variety of sizes of users from kids to adults such as sizes ranging from three to four feet in length for example.

Further the foam roll bath mat includes a hollow and cylindrical shaped foam roll tube located at one end of the bath mat. The cylindrical tube is secured to the bath mat via stitching thereby preventing the cylindrical tube from exiting the bath mat. The diameter of the internal cylindrical tube may vary in size. The end of the bath mat with the cylindrical tube is suitably used for a user to rest and elevate their legs while bathing. To use, a user will first place the bath mat into a bathtub suction cups in contact with the floor of the bathtub. Once the mat is secure a user may enter and sit on the flat part of the bath mat and placing their legs over the cylindrical tube portion. Once their bath is complete they may exit the bathtub and remove the bath mat by lifting upwards thereby releasing the suction cups from the bathtub floor for future use.

The preferred embodiment of the foam roll bath mat 100, as illustrated in FIGS. 1-4, comprises a main panel 110 including a bottom layer 130 formed from a flexible, waterproof material, a top layer 120 connected to and covering the bottom layer and formed from a thermoplastic elastomer, an elongated front edge 140, a side edge 141 connected to the front edge, and a plurality of releasable connectors 150 connected to a bottom surface of the bottom layer and are adapted to releasably connect with a surface of a bathtub or shower, wherein the main panel is substantially flat, elongated, and adapted to releasably connect with a surface of the bathtub or shower; an elongated tubular sleeve 160 connected to and extending along the length of the front edge of the main panel; and an elongated cylindrical support 170 having a length preferably equal to the length of the elongated tubular sleeve, is removably located within the elongated tubular sleeve, and is adapted to support a portion of a user's body while bathing, such that the foam roll bath mat is adapted to releasably connect to a surface of a bath and provide support to the user while bathing.

Further details of the preferred embodiment include the bottom layer 130 being formed from rubber or plastic; the releasable connectors 150 can be formed as suction cups, but can also be formed as magnets, from hook and loop fasteners, and any other releasable fastener known on the art of bathtubs and showers. The suction cups are also preferably formed from rubber or plastic. As for the elongated tubular sleeve 160, it can be connected to the front edge of the main panel via stitching 165 or other methods of attachment known in the art of mats and bath mats. The elongated tubular sleeve 160 is preferably formed from a thermoplastic elastomer. The main panel can be formed with three elongated side edges (141, 142, 143) thereby forming a substantially rectangular shape with the front edge 140. The elongated cylindrical support 170 is preferably formed as a tube having a cylindrically shaped hollow center 172 and formed from a polyethylene foam material. The lengths of the elongated tubular sleeve and the elongated cylindrical support can be formed as being greater than the length of the front edge of the main panel.

Uses of the foam roll bath mat 100 include supporting the legs of a user while bathing in a shower or bath tub 200; supporting the lumbar section of a user's back while bathing; and supporting the neck or head of a user while bathing. When in use the foam roll bath mat 100 can keep a user's bottom side from sliding upon a supporting surface of a bathtub.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

What is claimed is:

1. An improved bath mat comprising:
a main panel including:
a bottom layer;
wherein said bottom layer is formed from a flexible, waterproof material;
a top layer;
wherein said top layer is connected to and substantially covers said bottom layer, and is formed from a thermoplastic elastomer;
an elongated front edge;
wherein said elongated front edge has a length;
at least one elongated side edge connected to said front edge; and
a plurality of releasable connectors:
wherein said plurality of releasable connectors are connected to a bottom surface of said bottom layer and adapted to releasably connect with a surface of a bath;
wherein said main panel is substantially flat, elongated, and adapted to releasably connect with said surface of said bath;
an elongated tubular sleeve;
wherein said elongated tubular sleeve has a length and is connected to and extends along a substantial portion of said length of said front edge of said main panel; and
an elongated cylindrical support;
wherein said elongated cylindrical support has a length substantially equal to said length of said elongated tubular sleeve, is removably located within said elongated tubular sleeve, and is adapted to support a portion of a user's body while bathing;
wherein said improved bath mat is adapted to releasably connect with said surface of said bath and provide support to said user while bathing.

2. The improved bath mat of claim 1, wherein said bottom layer is formed from a material chosen from a group of materials consisting of rubber and plastic.

3. The improved bath mat of claim 1, wherein said plurality of releasable connectors are formed a suction cups.

4. The improved bath mat of claim 3, wherein said plurality of releasable connectors are formed from a material chosen from a group of materials consisting of rubber and plastic.

5. The improved bath mat of claim 1, wherein said elongated tubular sleeve is connected to said front edge of said main panel via stitching.

6. The improved bath mat of claim 1, wherein said elongated tubular sleeve is formed from a thermoplastic elastomer.

7. The improved bath mat of claim 1, wherein said main panel includes three elongated side edges forming a substantially rectangular shape with said front edge.

8. The improved bath mat of claim 1, wherein said elongated cylindrical support is formed as a tube having a cylindrically shaped hollow center.

9. The improved bath mat of claim 1, wherein said elongated cylindrical support is formed from a foam material.

10. The improved bath mat of claim 9, wherein said foam material is polyethylene foam material.

11. The improved bath mat of claim 1, wherein said lengths of said elongated tubular sleeve and said elongated cylindrical support are greater than said length of said front edge of said main panel.

12. A combination of a bath and an improved bath mat, said combination comprising:
a bath including:
at least one surface adapted to support a person while bathing; and
an improved bath mat comprising:
a main panel including:
a bottom layer;
wherein said bottom layer is formed from a flexible, waterproof material;
a top layer;
wherein said top layer is connected to and substantially covers said bottom layer, and is formed from a thermoplastic elastomer;
an elongated front edge;
wherein said elongated front edge has a length;
at least one elongated side edge connected to said front edge; and
a plurality of releasable connectors:
wherein said plurality of releasable connectors are connected to a bottom surface of said bottom layer and adapted to releasably connect with a surface of said bath;

wherein said main panel is substantially flat, elongated, and adapted to releasably connect with said surface of said bath;

an elongated tubular sleeve;

wherein said elongated tubular sleeve has a length and is connected to and extends along a substantial portion of said length of said front edge of said main panel; and an elongated cylindrical support;

wherein said elongated cylindrical support has a length substantially equal to said length of said elongated tubular sleeve, is removably located within said elongated tubular sleeve, and is adapted to support a portion of a user's body while bathing;

wherein said improved bath mat is adapted to releasably connect with said surface of said bath and provide support to said user while bathing.

13. The improved bath mat of claim 12, wherein said bottom layer is formed from a material chosen from a group of materials consisting of rubber and plastic.

14. The improved bath mat of claim 12, wherein said plurality of releasable connectors are formed a suction cups.

15. The improved bath mat of claim 14, wherein said plurality of releasable connectors are formed from a material chosen from a group of materials consisting of rubber and plastic.

16. The improved bath mat of claim 12, wherein said elongated tubular sleeve is connected to said front edge of said main panel via stitching.

17. The improved bath mat of claim 12, wherein said elongated tubular sleeve is formed from a thermoplastic elastomer, and wherein said elongated cylindrical support is formed from a polyethylene foam material.

18. The improved bath mat of claim 12, wherein said main panel includes three elongated side edges forming a substantially rectangular shape with said front edge.

19. The improved bath mat of claim 12, wherein said elongated cylindrical support is formed as a tube having a cylindrically shaped hollow center.

20. The improved bath mat of claim 12, wherein said lengths of said elongated tubular sleeve and said elongated cylindrical support are greater than said length of said front edge of said main panel.

* * * * *